United States Patent [19]

van Raalte

[11] 4,028,575

[45] June 7, 1977

[54] ELECTRON MULTIPLIER IMAGE DISPLAY DEVICE

[75] Inventor: John A. van Raalte, Princeton, N.J.

[73] Assignee: RCA Corporation, New York, N.Y.

[22] Filed: Nov. 28, 1975

[21] Appl. No.: 636,042

[52] U.S. Cl. ..... 313/105 R; 328/243

[51] Int. Cl.² ..... H01J 43/20; H01J 43/10; H01J 31/48

[58] Field of Search ..... 313/105 R, 105 CM, 104, 313/103 R, 103 CM, 95, 400, 409, 411, 414, 417; 250/213 VT; 340/324 M; 315/169 TV; 328/243

[56] References Cited

UNITED STATES PATENTS

| | | | |
|---|---|---|---|
| 3,408,532 | 10/1968 | Hultberg et al. | 313/105 CM X |
| 3,505,559 | 4/1970 | Jeffries et al. | 313/105 R X |
| 3,519,870 | 7/1970 | Jensen | 313/105 CM |
| 3,735,184 | 5/1973 | Maeda | 313/105 |
| 3,784,831 | 1/1974 | Reif | 250/213 VT |
| 3,904,923 | 9/1975 | Schwartz | 313/105 R X |

FOREIGN PATENTS OR APPLICATIONS

| | | | |
|---|---|---|---|
| 107,443 | 5/1939 | Australia | 313/105 |
| 2,263,614 | 7/1974 | Germany | 313/103 |

*Primary Examiner*—Gerard R. Strecker
*Attorney, Agent, or Firm*—Glenn H. Bruestle; William H. Murray; George E. Haas

[57] ABSTRACT

A plurality of parallel, planar, area electron multipliers are mounted on a substrate having a plurality of electrical conductors in a coded pattern and a planar electron source thereon. Each multiplier comprises a plurality of dynode members, at least one of which is addressable, for controlling the generation of a linear electron beam which defines one video line in a flat image display device. Random or sequential generation of video lines is accomplished by generating unique combinations of electron repelling and accelerating voltages which are applied to the addressable dynode members through the coded electron conductors.

11 Claims, 8 Drawing Figures

ELECTRON MULTIPLIER IMAGE DISPLAY DEVICE

BACKGROUND OF THE INVENTION

This invention relates to video display line generators and particularly to video line generators which are randomly or sequentially addressable for use in a flat image display device.

A flat image display device has several advantages over the prior art electron beam scanning devices such as the cathode ray tube. A significant advantage is the relative compactness of the flat image dislay device.

Conventional televison picture tubes comprise an elongated glass envelope having a phosphor coated faceplate at one end and an electron gun at the other end for generating a focused beam of electrons toward the phosphor screen. An elongated structure is required to accommodate the electron gun and deflection system. Consequently, in order to preserve linearity and definition of the display, an increase in the size of the display screen must be accompanied by an increase in the depth of the tube. As a result, a large display screen, for example 3 feet × 4 feet, would require a beam scanning tube of unmanageable bulk for most practical purposes.

In addition, prior art cathode ray tube devices are inherently suitable for scanning in a substantially sequential manner precluding random addressing on a line-at-a-time basis. This limitation impairs the versatility of such devices as well as their efficiency of operation in response to a randomly addressed inputs as might be involved in a memory or storage tube or a specialized display application.

One significant drawback associated with flat image display devices relates to the addressing or scanning capability. In conventional beam scanning television tubes vertical scanning of the standard 524 lines can be accomplished using a small number of leads connected to the deflection system. In a line or area cathode device of the type suitable for flat image displays, as many as 524 leads may be required just to accomplish the vertical scanning. This becomes a problem since bringing out a minimim of 524 leads through a vacuum seal is not a trivial matter One way of reducing the number of leads required for line-at-a-time addressing in a flat image display device is to employ dynodes having digitally coded electrodes thereon for applying electron accelerating and repelling potentials, see for example U.S. Reissue Patent No. 27,520 issued to Hultberg, et al. One disadvantage of this approach is that the digital coding makes each dynode member unique; consequently, a device for scanning 512 lines would require several different dynode members. As a result, the minimum number of dynode members will be dictated, in most practical applications, by the digital coding and not by the electron emission characteristics of the materials selected.

SUMMARY OF THE INVENTION

An addressable video line generator for a flat image display device comprises a substrate having a planar electron source on one surface thereof. A plurality of substantially parallel, planar area electron multipliers are on the one surface of the substrate in substantially orthogonal spaced relation to the planar electron source. Each multiplier comprises a substantially linear output aperture and a plurality of dynode members, at least one of which is addressable, between the electron source and the output aperture for multiplying and controlling the flow of a substantially linear electron beam therebetween. Also included are digital control means for applying an accelerating voltage or an inhibitng voltage to each addressable dynode member and accelerating voltages to the remaining dynode members in response to a control signal.

DETAILED DESCRIPTION

Figure 1:
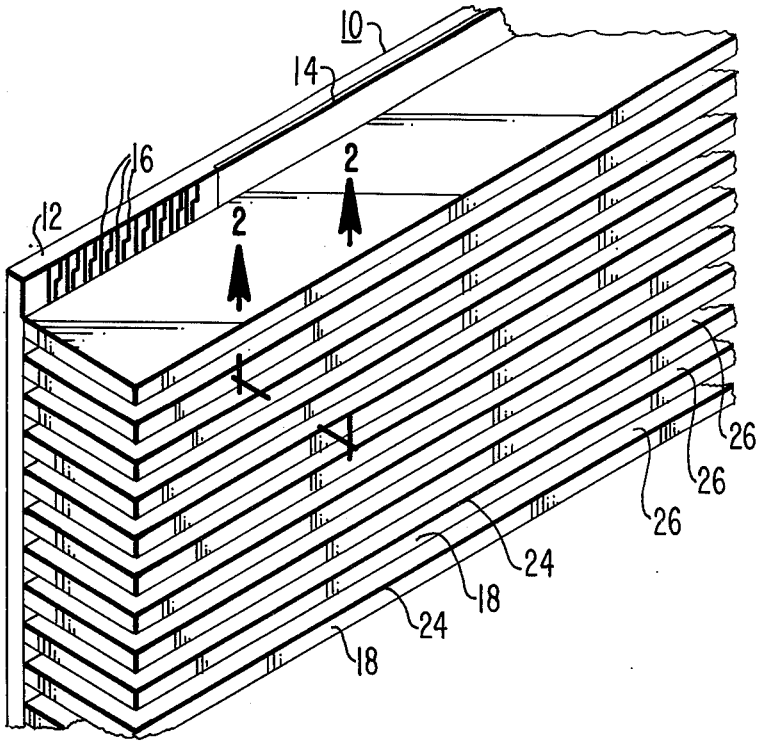
FIG. 1 is an isometric view of a portion of one form of an addressable video line generator of the present invention.

Referring initially to FIG. 1, one form of an addressable video line generator of the present invention is generally designated as 10. The addressable video line generator 10 comprises a substrate 12 having a planar electron source 14 on one surface thereof. The substrate 12 comprises a substantially flat plate of an electrically insultating material such as glass. In the preferred embodiment of the device, the overall dimensions of the substrate are 84 centimeters high by 112 centimeters wide by 0.63 cm thick. The planar electron source 14 comprises a layer of a material capable of emitting electrons when bombarded by ions or photons. In this embodiment, the planar electron source 14 covers an area of the substrate having dimensions of 76 centimeters high by 102 centimeters wide.

Figure 2:
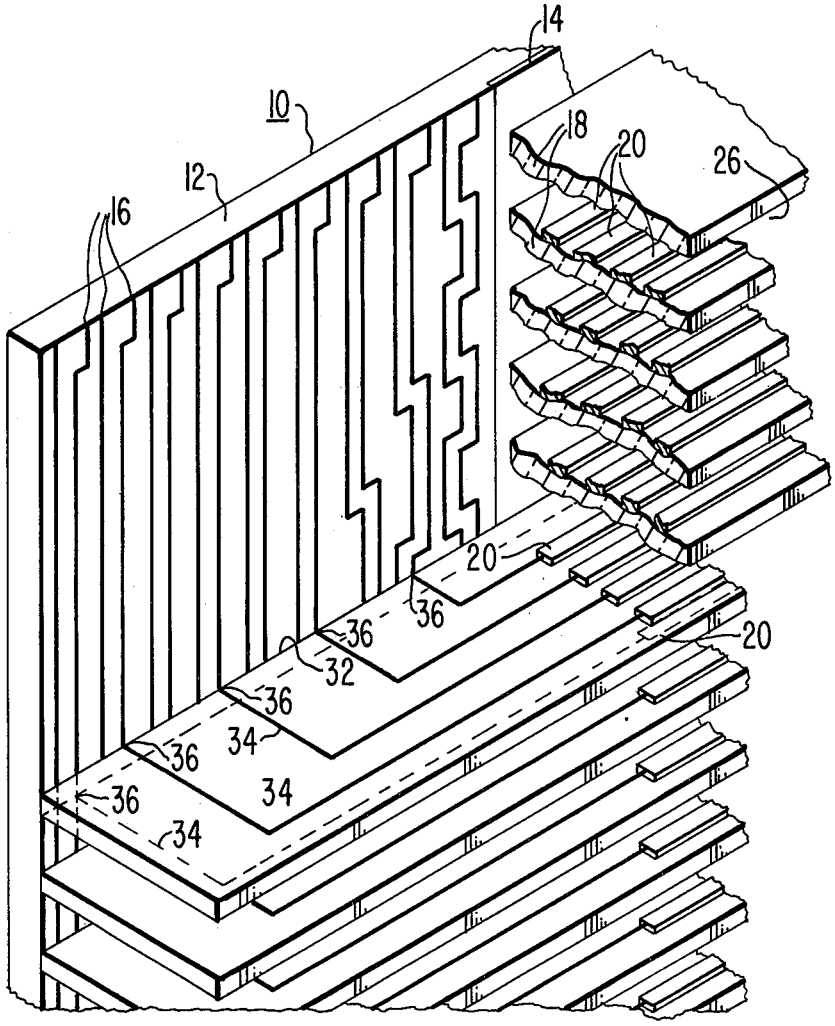
FIG. 2 is an enlarged isometric view of that portion of FIG. 1 encompassed by line 1—2 having portions of five dynode support elements cut away to show a portion of the pattern of coded electrical conductors on the substrate.

As shown in FIG. 2, a plurality of substrate electrical conductors 16 are formed on the substrate 12 adjacent to the electron source 14 in a predetermined coded pattern using known printed circuit techniques such as for example screening an electrically conductive ink. Although FIG. 2 shows eighteen substrate conductors in a distinctive coded pattern, the actual number of substrate conductors as well as the coded pattern used is a function of the number of addressable dynode members per electron multiplier. The relationship between the quantity of addressable dynode members, the required number of substrate conductors and the method for developing the coded pattern of conductors will be developed more fully as the detailed description proceeds.

A plurality of dynode support elements 18 is mounted in parallel spaced relationship on the substrate 12 substantially orthogonal to the planar electron source 14. Each dynode support element 18 comprises a substantially flat strip of an electrically insulating material, such as glass, having at least one stripe-shaped dynode member 20 thereon. A dynode member 20 of the preferred embodiment comprises a strip 21 (see FIG. 3) of an electrically conductive material, such as copper, having a layer 22 of a secondary electron emission substance, such as magnesium oxide thereon.

Figure 3:
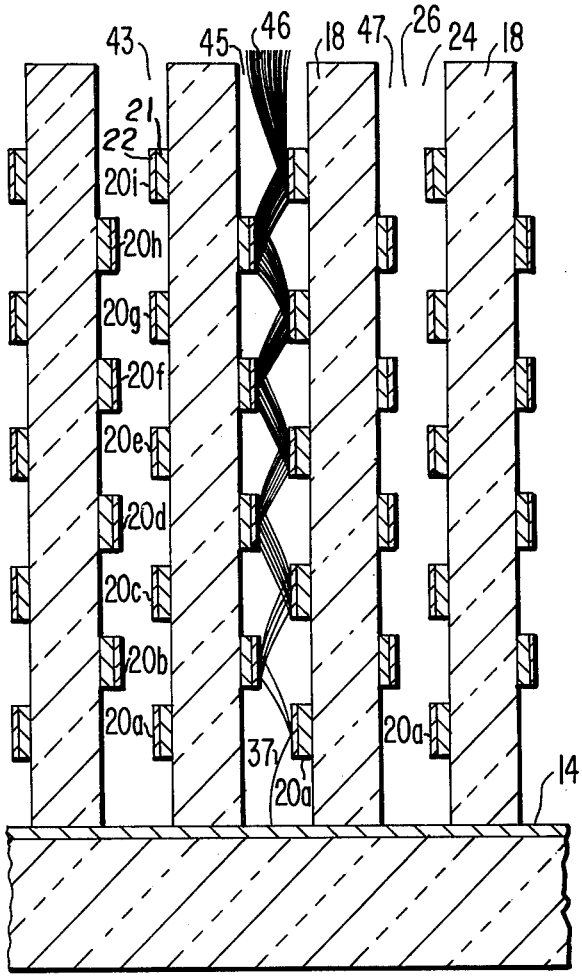
FIG. 3 is an enlarged sectional view of three electron multipliers.

As shown in FIGS. 1 and 3, each adjacent pair of parallel dynode support elements 18, having dynode members 20 thereon, forms a planar area electron multiplier 24 having a substantially linear output aperture 26. Since, in the preferred embodiment disclosed herein, a dynode support element 18 is common to adjacent electron multipliers 24, each dynode support element 18 will have dynode members on opposite broad surfaces thereof. As shown in FIG. 3, the preferred embodiment includes five parallel dynode members 20 on one broad surface of each dynode support element 18 and four parallel dynode membes 20 on the opposite broad surface.

In order to simplify the making of electrical connections to each dynode member, the dynode members 20 are electrically terminated at one edge 32 (see FIG. 2) of the dynode support element 18 by means of support element electrical conductors 34. Consequently, an electrical terminal 36 for each dynode member 20 is located at the one edge 32 of the dynode support element 18. Since the dynode members themselves are electrically conductive, a voltage applied to the electrical terminal 36 will appear across the entire length of the dynode member 20. As shown in FIG. 1, the dynode support elements 18 are mounted on the substrate 12 substantially equidistant from and parallel to each other. As shown in FIG. 2, the electrical terminals 36 of the dynode members 20 are electrically connected to the appropriate substrate electrical conductors 16 on the substrate 12.

The operation of the device is as follows. Referring to FIG. 3, the electron source 14 comprises a material having high electron emission characteristics, i.e., having a secondary electron emission coefficient greater than one. Operation of the electron multiplier 24 commences when an electron 37 is emitted from the electron source 14 and strikes the nearest dynode member 20*a* of the electron multiplier. This electron then creates secondary emission and is thereby multiplied by the gain of the dynode member so that a plurality of electrons leave the nearest dynode member to strike the next dynode member 20*b*. Multiplication of electrons continues through each dynode member in a similar manner until a large number of electrons leave the last dynode member 20*i*. Because of the high multiplication of electrons, the primary emission from the electron source 14 can be extremely low.

Figure 4:
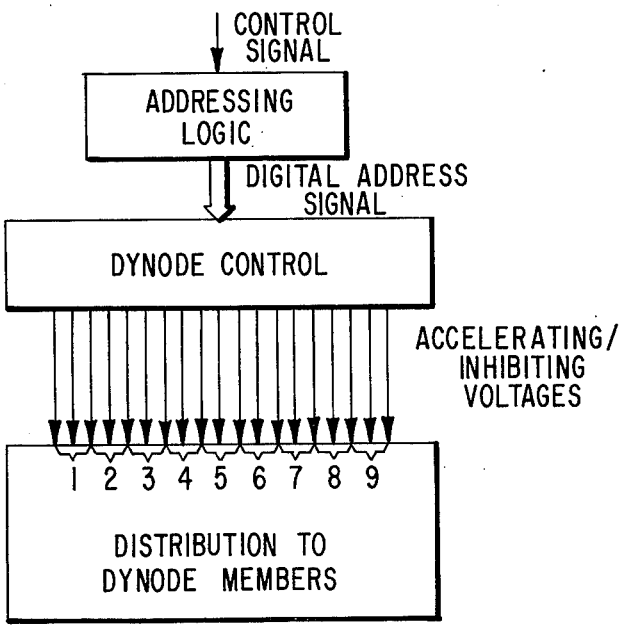
FIG. 4 is a schematic block diagram of the addressing and dynode control portions of the device of the present invention.

The device of this invention incorporates the principle that the flow of electrons through an electron multiplier using a plurality of dynode members can be inhibited by applying an electron repelling voltage to a single dynode member within the selected multiplier. As shown in FIG. 4, a control signal is applied to the device addressing logic circuitry. The control signal contains information as to the location and sequence of video lines to be generated. The addressing logic converts this information to a digital address signal. The digital address signal in this embodiment comprises a binary coded address transmitted in parallel to the dynode control circuitry across nine lines. The binary signal appearing on the nine lines can uniquely select any one of $2^9$ or 512 lines. The dynode control circuitry converts the binary coded address to a unique combination of eighteen electron accelerating and repelling voltages, which are subsequently applied to the dynode members through the 18 substrate conductors 16.

Figure 5:
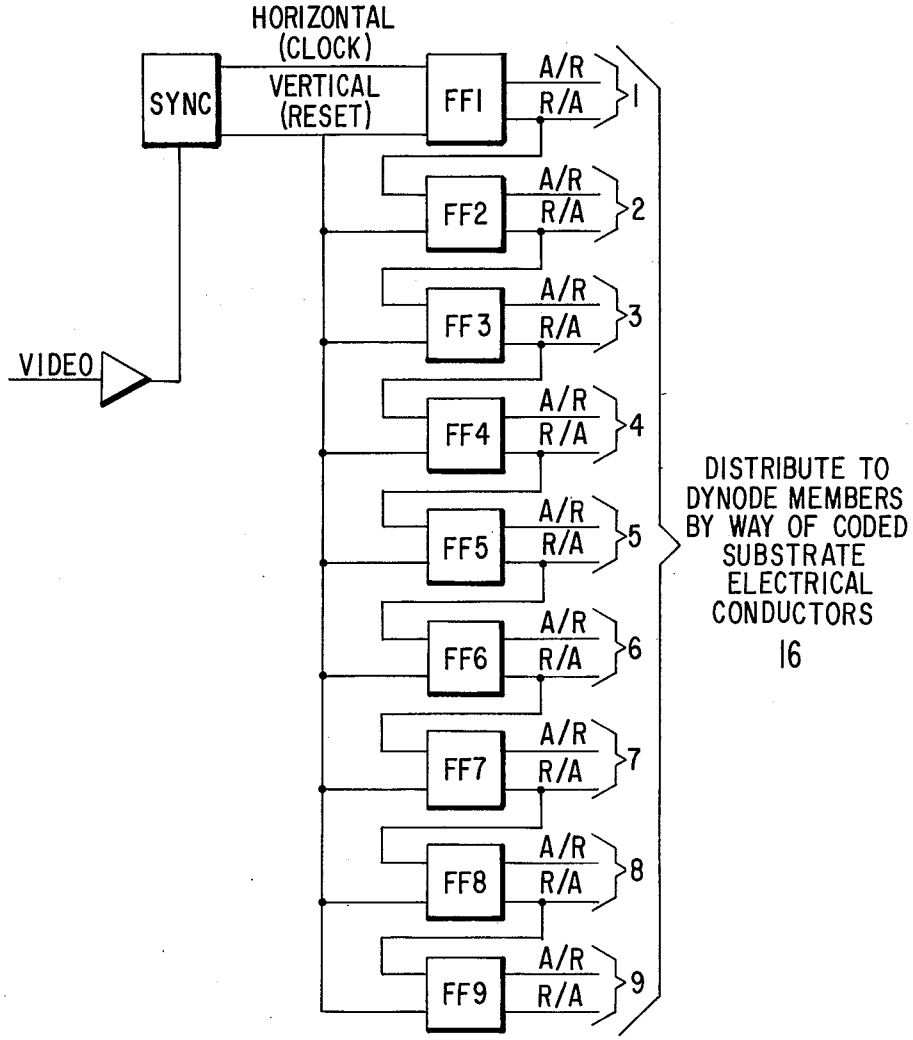
FIG. 5 is a schematic block diagram showing an embodiment of the addressing and dynode control portions of the device which enables sequential generation of video lines.

FIG. 5 is a schematic block diagram showing the use of the device of the present invention as a sequential video line generator. The sync portion of the incoming video signal is stripped out and separated into horizontal and vertical sync signals. The horizontal sync signal functions as a clock which advances a binary counter, represented by flip-flops one through nine. Each flip-flop causes an accelerating (A) or a repelling (R) voltage to be applied to each of the substrate conductors 16. The vertical sync signal functions as a reset which sets the initial states of the flip-flops prior to the beginning of each new frame.

Figure 6:
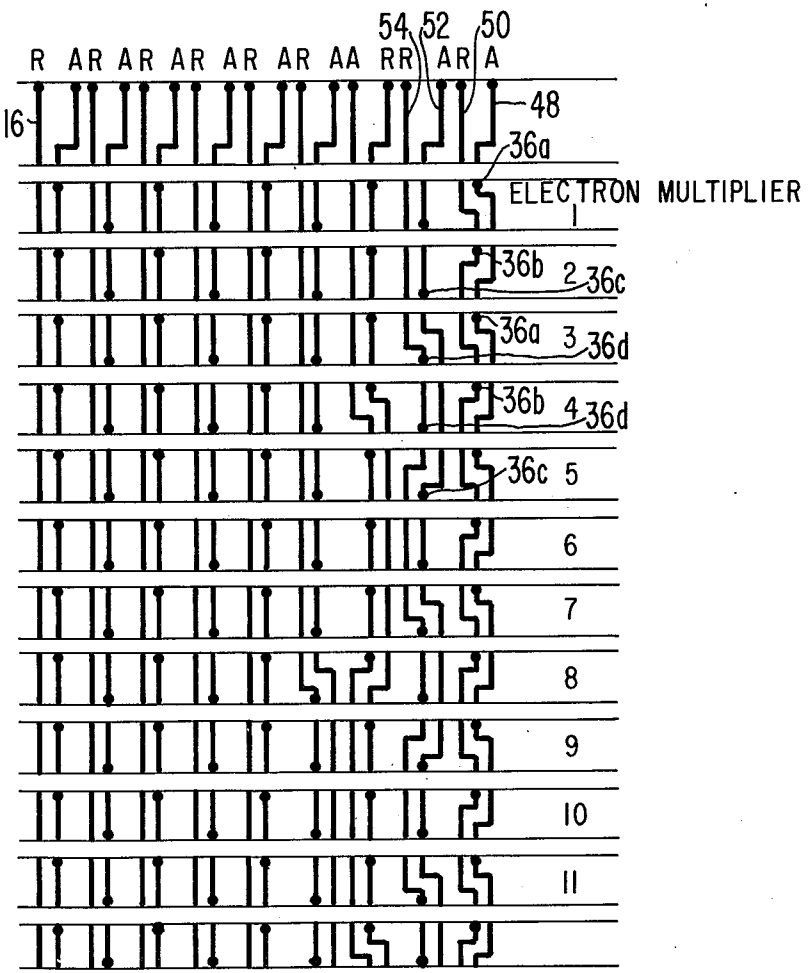
FIG. 6 is a plan view of a portion of the substrate of the device of the present invention showing a portion of the pattern of the electrica conductors thereon.

As shown in FIGS. 2 and 6, the substrate conductors 16 are formed in a pattern whereby each conductor pair, interconnecting dynode members in the same relative position of the electron multipliers, by way of the electrical terminals 36 and the support element electrical conductors 34, are digitally coded with respect to every other conductor pair. That is, in the embodiment described herein, one conductor of each pair electrically connects one-half of the dynode members in the same relative position while the other conductor connects the other half. In the pattern of the embodiment disclosed herein, as shown in FIG. 6, the dynode member occupying the ninth position of the first, third, fifth, etc. multipliers are electrically connected to each other by means of a first electrical conductor 48, the electrical connections between the first electrical conductor 48 and the appropriate support element electrical conductors being made at the electrical terminals 36*a*. Dynode members occupying the ninth position of the alternate multipliers two, four, six, etc. are electrically connected by means of a second electrical conductor 50 at the electrical terminals 36*b*. Similarly, the dynode members occupying the eighth position of multipliers one, two, five, six, nine, 0, etc. are electrically connected to each other by means of a third electrical conductor 52 at the terminals 36*c*, while dynode members in the eighth position of multipliers three, four, seven, eight, 11, 12 etc. are electrically interconnected by means of a fourth electrical conductor 54 at the terminals 36*d*. This pattern is repeated with alternate multiplier quartets, octets, and so forth, the alternate groupings insuring that each half of the dynodes in the same relative position are electrically connected together. Consequently, since a repelling voltage is applied to one lead of each pair and an accelerating voltage is applied to the other lead, a repelling voltage will appear on one half of the dynodes in the same relative position on the electron multipliers and an accelerating voltage on the other half.

The following discrete example is given to clarify yhe description of the operation of the preferred embodiment of the device. FIG. 6 depicts a portion of the pattern of the substrate conductors 16 as well as electron multipliers one through eleven. In this example, it is desired to cause a substantially linear electron beam to appear at the output aperture of electron multiplier number five. In response to the apropriate control signal, the addressed logic circuitry transmits a nine bit binary-coded address word, for example, 001000000. The dynode control circuitry converts this address to a combination of nine repelling (R) and nine accelerating (A) voltages, as shown in FIG. 5. With the application of repelling (R) and accelerating (A) voltages as shown in FIG. 6, only electron multiplier five will have an accelerating voltage applied to the dynode members occupying all nine positions. Electron multiplier four, for example, will have accelerating (A) voltages applied to the dynode members occupying positions one through six, and repelling (R) voltages applied to the dynode members ocupying positions seven, eight and nine. Similary, electron multiplier six will have accelerating (A) voltages applied to dynode members occupying positions one through eight and a repelling (R) voltage applied to the dynode member occupying position nine.

Referring to FIG. 3, there is shown an enlarged cross-sectional view representing electron multipliers four, five and six, designated by reference numbers 43, 45 and 47 respectively. As stated previously, every dynode member of electron multiplier five 45 has an accelerating potential applied to it. Therefore, the electrons 46 will multiply and be accelerated through multiplier five. With respect to electron multiplier four 43, the repelling voltage applied to the dynode member in the seventh position, 20*a*, will cause the electrons emanating from the electron source 14 to be repelled, thereby interruptng the flow of electrons through multiplier four. Similarly, with respect to electron multiplier six 47, the repelling voltage applied to the dynode member 20*a*, in the ninth position will cause the interruption of the flow of electrons through multiplier six. Consequently, only electron multiplier five will permit the uninterrupted flow of electrons therethrough. Therefore, only electron multiplier five will have the electron beam appearing at its output aperture 26.

Although the embodiment of the device described herein discloses the use of nine dynode members per electron multiplier, all of which dynode members are addressable, the usable combinations of addressable and non-addressable dynode members are much broader than this. As stated previously, each electron multiplier only one addressably dynode member out of the total number of dynode members per multiplier in order to interrupt the flow of electrons therethrough. Consequently, at least one dynode member of each electron multiplier must be addressable. The total number of dynode members used per electron multiplier is determined by the desired electron gain. The number of dynode members which are addressable is a function of the number of multipliers required for the display as well as the minimum number of substrate connectors desired. This relationship is more fully developed in subsequent paragraphs.

The primary object of this invention is to reduce the number of leads which are required to selectively generate one line of video. In accordance with the device of this disclosure, the number of these leads $n$ is equal to $(m-j)+j\sqrt{N_o}$ where $m$ is equal to the total number of dynode members per multiplier, $j$ is equal to the number of addressable dynode members per multiplier, $<j<m$, and $N_o$ is equal to the number of multipliers. In standard television displays a minimum of 500 lines or, as embodied in this device, 500 multipliers, would be required. Consequently, in the formula above, $N_o$ must assume an integer value greater than or equal to 500. Utilizing a figure of greater than or equal to 500 for $N_o$, the following table shows the relationships between the number of addressable dynode members $j$ and the number of leads $n$ required to uniquely select one video line out of $N_o$ total video lines

TABLE I

| j | $\sqrt[j]{N_o}$ | n | $N_o$ |
|---|---|---|---|
| 2 | 23 | 46 | 529 |
| 3 | 8 | 24 | 512 |
| 4 | 5 | 20 | 625 |
| 5 | 4 | 20 | 1024 |
| 6 | 3 | 18 | 729 |
| 7 | 3 | 21 | 2187 |
| 8 | 3 | 24 | 6561 |
| 9 | 2 | 18 | 512 |

Consequently, as shown in the above table, having two addressable dynodes per electron multiplier would require 46 leads to uniquely select one electron multiplier out of a total of 529. Similarly, having three addressable dynode members, 24 leads would be required to uniquely select one electron multiplier out of a total of 512 and so on. The last entry in the table shows the relationship described in the preferred embodiment, i.e., having nine addressable dynode members, eighteen leads are required to uniquely select one electron multiplier out of a total of 512.

Table 1 shows the minimum number of leads (n) required to uniquely address one of $N_o$ multipliers, given a specific number ($j$) of addressable dynode members In each cause a different code is used to interconnect the addressable dynode members occupying the same relative position ($x = 1, 2, \ldots, j$) of the $N_o$ different electron multipliers.

In general, each of the addressable dynode members occupying the same relative positions on their respective multipliers are interconnected into $k$ groups ($k = N_o^{1/3}$), requiring only $k$ electrical connections for addressing purposes. Only one of each set of $k$ connections has an accelerating potential applied to it ("on") while the others have a retarding potential applied to them ("off"). Thus, it follows that a total of $k \cdot N_o^{1/3}$ electrical connectons are required to uniquely select one of $N_o$ multipliers.

For example, in a device having only three addressable dynode members ($j = 3$) on each of 512 electron multipliers ($N_o = 512$), there would be eight ($k = N_o^{1/3} = 8$) sub groups for each of the three addressable dynode sets and $3 \cdot 8 = 24$ addressing leads. The dynodes occupying the third position ($x = 3$) in each multiplier are alternately connected to each of the eight addressing leads corresponding to that third dynode set. Thus, the dynodes of multipliers 1, 9, 17 . . .505 are connected together to the first lead. Similarly, dynodes of multipliers 2, 10, 18, . . .506 are connected to the second lead, and so on. In this manner, eight groups are formed of 64 multipliers each. Obviously, if an accelerating potential is applied to only one of these eight groups, then only a multiplier belonging to that group can turn "on".

The dynodes occupying the other two positions ($x = 2$ and $x = 1$) are also interconnected into eight groups each, but the interconnection pattern is different in each case. In fact, the interconnection pattern is arranged so that no two multipliers have all their dynodes connected to common leads. This insures that an accelerating voltage applied to only one addressing lead in each dynode-position-group allows only one multiplier to turn "on". Every other multiplier of the $N_o$ multipliers has one or more dynodes with a retarding potential on it to turn it "off".

In this example, the dynodes occupying the second position ($x = 2$) are first connected together in groups of eight. That is, the dynodes occupying the second position of multipliers 1 through 8 are connected together as are dynodes of multipliers 9 through 16, 17 through 24, . . ., and 505 through 512. This then forms 64 sub-groups of eight multipliers each. These sub-groups are further interconnected alternately to the eight addressing leads corresponding to this dynode position. Thus, dynodes of multipliers 1 through 8 are connected to lead 1, dynodes of multipliers 9 through 16 to lead 2, . . ., and dynodes of multipliers 57 through 64 to lead 8. This process is continued and therefore dynodes of multipliers 65 through 72 are also tied to lead 1, dynodes of multipliers 73 to 80 to lead 2, and so on until all 512 dynode positions have been connected to one of eight addressing leads. Consequently, each lead again has 64 dynodes connected to it. The dynodes occupying the first position ($x = 1$) are also connected to eight addressing leads. However, here dynodes of multipliers 1 through 64 are connected to lead 1, dynodes of multipliers 65 through 128 to lead 2, . . ., and dynodes of multipliers 449 through 512 to lead 8.

In the specific embodiment discussed previously, where there are nine ($j = 9$) addressable dynodes and $N_o = 512$ multipliers, each dynode position requires two ($512^{1/9} = w$) addressing leads for a total of 18 ($2 \times 9 = 18$) leads. In this case, the dynodes occupying the ninth position ($x = 9$) are alternately connected to the two addressing leads. That is, the dynodes of all odd numbered multipliers are connected to lead 1 and those of all even numbered multipliers to lead 2. The dynodes occupying the eighth position are alternately connected in adjacent pairs to their two addressing leads. That is, dynodes of multipliers 1,2, 5,6, 9,10, . . ., 509,510 to one lead and dynodes of multipliers 3,4, 7,8, 11,12, . . ., 511,512 to the other lead. The dynodes in the seventh position are alernately connected to two additional addressing leads in groups of four adjacent multipliers. In the case of the sixth position dynodes, the groups contain eight adjacent dynodes and so on. Table 2 shows the dynodes occupying positions 1 through 9 which are connected to a common addressing lead. Note that the addressing leads are different for each different dynode position group.

TABLE 2

Dynode Interconnection Pattern for 512 Multipliers, Each Having 9 Addressable Dynodes

| | DYNODE POSITION NUMBER | | | | | | | | |
|---|---|---|---|---|---|---|---|---|---|
| | 1 | 2 | 3 | 4 | 5 | 6 | 7 | 8 | 9 |
| Dynodes Connected to Lead No. 1 | 1 thru 256 | 1 thru 128<br>257 thru 384 | 1 thru 64<br>129 thru 192<br>257 thru 320<br>385 thru 448 | 1 thru 32<br>65 thru 96<br>129 thru 160<br>193 thru 224<br>257 thru 288<br>321 thru 352<br>385 thru 416<br>449 thru 480 | 1 thru 16<br>33 thru 48<br>65 thru 80<br>97 thru 112<br>385 thru 400<br>417 thru 432<br>449 thru 464<br>481 thru 496 | 1 thru 8<br>17 thru 24<br>33 thru 40<br>49 thru 56<br>449 thru 456<br>465 thru 472<br>481 thru 488<br>497 thru 504 | 1 thru 4<br>9 thru 12<br>17 thru 20<br>25 thru 28<br>481 thru 484<br>489 thru 492<br>497 thru 500<br>505 thru 508 | 1,2<br>5,6<br>9,10<br>13,14<br>497,498<br>501,502<br>505,506<br>509,510 | 1<br>3<br>5<br>7<br>505<br>507<br>509<br>511 |
| Dynodes Connected to Lead No. 2 | 257 thru 512 | 129 thru 256<br>385 thru 512 | 65 thru 128<br>193 thru 256<br>321 thru 384<br>449 thru 512 | 33 thru 64<br>97 thru 128<br>161 thru 192<br>225 thru 256<br>289 thru 320<br>353 thru 384<br>417 thru 448<br>481 thru 512 | 17 thru 32<br>49 thru 64<br>81 thru 96<br>113 thru 128<br>401 thru 416<br>433 thru 448<br>465 thru 480<br>497 thru 512 | 9 thru 16<br>25 thru 32<br>41 thru 48<br>57 thru 64<br>457 thru 464<br>473 thru 480<br>489 thru 496<br>505 thru 512 | 5 thru 8<br>13 thru 16<br>21 thru 24<br>29 thru 32<br>485 thru 488<br>493 thru 496<br>501 thru 504<br>509 thru 512 | 3,4<br>7,8<br>11,12<br>15,16<br>499,500<br>503,504<br>507,508<br>511,512 | 2<br>4<br>6<br>8<br>506<br>508<br>510<br>512 |

NOTE:
Table entries are the multiplier numbers. For example, the addressable dynodes in dynode position number 1 of multipliers 1 thru 256 are all electrically connected to lead No. 1 and those of multipliers 257 thru 512 are electrically connected to lead No. 2.

Since the substrate conductors 16 are formed on the substrate 12 in a predetermined coded pattern and each dynode electrical terminal 36 occupies the same relative position on every dynode support element 18, simply mounting the dynode support element at the right location on the substrate 12 will insure that the correct electrical connections are made to the appropriate dynode members. Note that although the preferred embodiment incorpoates elecrical conductors 16 which are in a coded pattern on the substrate 12, the required coding may be accomplished by formation of unique patterns of the electrical conductors 34 on the dynode support elements 18 leaving the electrical conductors 16 on the substrate uncoded, or any combination of codings on the substrate 12 and the dynode support elements 18 and all are to be considered within the scope and intendment of the invention disclosed herein.

Figure 7:
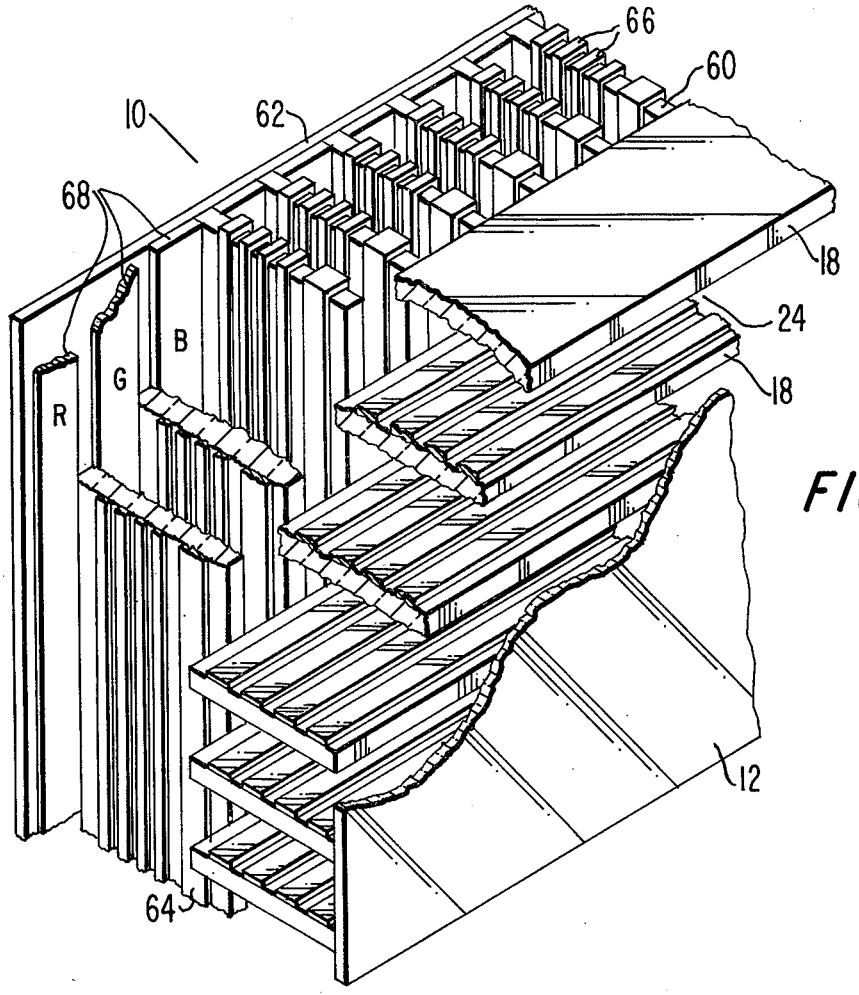
FIG. 7 is an isometric view of one form of a flat image display device utilizing the addressable video line generator of the present invention.
Figure 8:
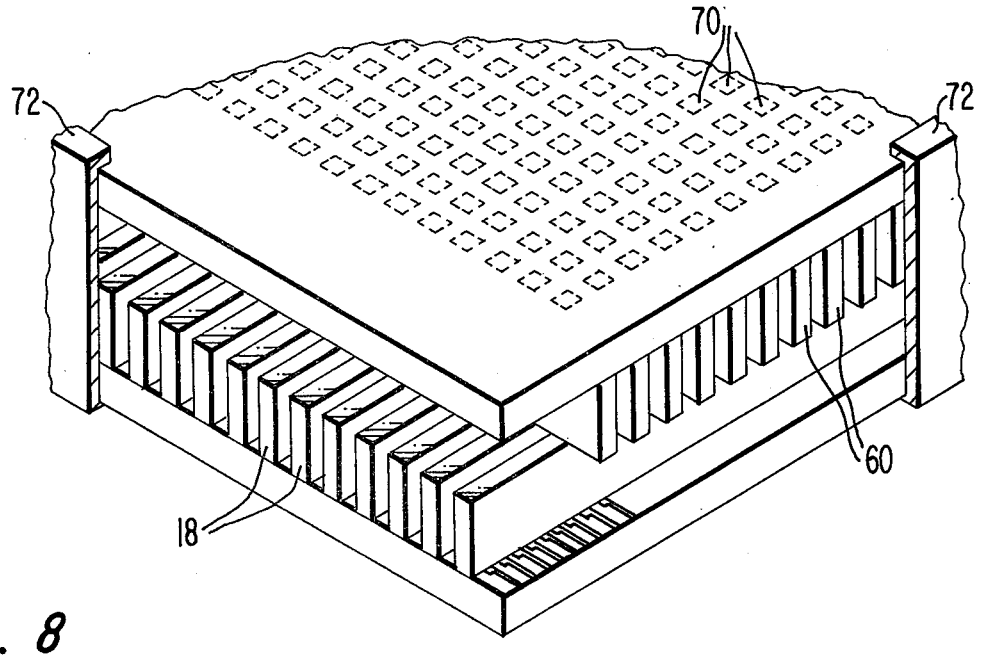
FIG. 8 is another isometric view of one form of a flat image display device utilizing the addressable video line generator of the present invention.

Referring to FIG. 7, there is shown one form of a flat image display device utilizing the addressable video line generator of the present invention. The device comprises a set of parallel vanes 60 positioned between a front viewing panel 62 and the dynode support elements 18, the vanes 60 being substantially orthogonal to the support elements 18. The actual viewing area of the front viewing panel 62 is substantially coextensive with the area of the planar electron source 14 described previously. Each vane 60 is coated with a plurality of stripe-shaped electrodes including a modulator stripe 64 and a plurality of accelerating and focusing stripes 66. The screen comprises a plurality of parallel vertical phosphor stripes 68, each phosphor stripe being located on the internal surface of the front panel 62 between two adjacent vanes 60. In a color version of this embodiment, the phosphor stripes 68 would vary in a red-green-blue color emitting pattern horizontally along the front viewing panel. Each horizontal row or video line of the image display device is defined by one electron multiplier 24 which comprises a pair of adjacent dynode support elements 18. Consequently, in accordance with United States television standards, there are 483 adjacent pairs of support elements forming 483 electron multipliers, each of which extends across the width of the viewing area. A picture element 70 (see FIG. 8) is subtended by the projection of the orthogonal intersection of a pair of vanes 60 and a pair of support elements 18 onto a corresponding phosphor stripe 68. In a color television version of this embodiment, there maybe 2100 picture elements 70 along each video line across the width of the viewing area. Consequently, the total picture elements in the color television version exceeds one million. The image display device is evacuated and sealed by a sealing member 72 as shown in FIG. 8.

Referring again to FIG. 7, a selected electron multiplier is addressed as previously described. The addressed electron multiplier produces a linear electron beam corresponding to a horizontal video line. The linear electron beam exits the multiplier output aperture 26 toward the front panel 62. The modulator stripes 64 control the quantity of electrons which are permitted to travel onto the vertical phosphor stripes 68. Those electrons which are passed by the modulator stripes 64 are then accelerated and focused onto the vertical phosphor stripes 68 by the accelerating and focusing stripes 66 on each vane 60 thereby causing each phosphor to emit light of its characteristic color in proportion to the number of striking electrons.

The major advantage of the device of the present invention over the prior art devices is that the coding of each dynode support element is automatically obtained as a function of the position of that dynode support element on the substrate electrical conductors. Also, the use of combinatorial techniques permits a significant reduction of the number of leads which are required to randomly address the relativey large number of video lines. In the example discussed in the detailed description, 512 video lines can be sequentially or randomly addressed using only 18 leads.

I claim:

1. An addressable video line generator for a flat image display device comprising:

a substrate;

a planar electron source on one surface of said substrate;

a plurality of substantialy parallel, planar, area electron multipliers on said one surface of said substrate in substantially orthogonal spaced relation to said planar electron source, each multiplier comprising a substantially linear output aperture and a plurality of dynode members between said electron source and said output aperture for multiplying and controlling the flow of a substantially linear electron beam therebetween, at least one of said dynode members being addressable; and control means for applying an accelerating voltage or an inhibiting voltage to each addressable dynode member and accelerating voltages to the remaining dynode members in response to a control signal.

2. An addressable video line generator in accordance with claim 1 in which said control means comprises:

addressing means for providing an address signal in response to said control signal;

dynode control means for providing a plurality of accelerating and inhibiting voltages in response to said address signal; and distribution means for routing said accelerating or inhibiting voltages to the appropriate addressable dynode members and accelerating voltages to the remaining dynode members.

3. An addressable video line generator in accordance with claim 2 in which said distribution means comprises a plurality of electrical conductors, the quantity of said conductors being equal to $(m-j)+j^{j}\sqrt{N_o}$ where $m$ is equal to the total number of dynode members per multiplier, $j$ is equal to the number of addressable dynode members per multiplier and $N_o$ is equal to the number of multipliers.

4. An addressable video line generator in accordance with claim 3 in which said electrical conductors electrically interconnect dynode members having the same relative position $x$ in different electron multipliers, the addressable dynode members being interconnected in $k_x$ groups of $l_x$ dynodes each where $k_x$ is equal to $N_o^{1/j}$ and $l_x$ is equal to $(N_o/k_x)$ said groups being in coded relation to each other such that each combination of accelerating and inhibiting voltages applied to the electrical conductors will cause a linear electron beam to be generated by at least one electron multiplier.

5. An addressable video line generator in accordance with claim 4 in which said electrical conductors are positioned in a predetermined pattern on said one surface of said substrate adjacent said electron source, the dynode members of said multipliers being electrically connected to the conductor pattern at predetermined locations.

6. An addressable video line generator in accordance with claim 5 in which each of said electron multipliers comprises a pair of planar dynode support elements, each dynode support element comprising a strip of an electrically insulating material which is positioned on the substrate such that a broad surface of one dynode support element of said pair faces a broad surface of the other dynode support element of said pair, said facing surfaces being in substantially parallel spaced relation to each other and substantially orthogonal to said planar electron source, each facing surfacing surface having at least one dynode member thereon.

7. An addressable video line generator in accordance with claim 6 in which adjacent electron multipliers share a dynode support element, each of said shared dynode support elements comprising a strip of an electrically insulating material having two opposed broad surfaces with at least one dynode member on each of said opposed surfaces.

8. An addressable video line generator in accordance with claim 7 in which said dynode member comprises a strip of an electrically conductive material having a secondary electron emission coefficient greater than one said strip being mounted on said dynode support element in substantially parallel spaced relation to said planar electron source.

9. A flat image dislay device comprising:

a substrate;

a planar electron source on one surface of said substrate;

a plurality of substantially parallel, planar, area electron multipliers on said one surface of said substrate in substantially orthogonal spaced relation to said planar electron source, each multiplier comprising a substantially linear output aperture and a plurality of dynode members between said electron source and said output aperture for multiplying and controlling the flow of a substantially linear electron beam therebetween, at least one of said dynode members being addressable;

control means for applying an accelerating voltage or an inhibiting voltage to each addressable dynode member and accelerating voltages to the remaining dynode members in response to a control signal;

means for modulating the electron beams from each of said multipliers;

means for accelerating the modulated electron beams; and a cathodoluminescent screenexcitable by the accelerated and modulated electron beams.

10. A flat image display device in accordance with claim 9 comprising a matrix of cathodoluminescent cells, each cell formed by a substantially orthogonal intersection of an electron multiplier and a pair of parallel vanes comprising said modulation and acceleration means.

11. A flat image display device in accordance with claim 10 in which the cathodoluminescent screen comprises a plurality of phosphor deposits, each phosphor deposit being associated with a cell of said matrix and wherein said phosphor deposits include at least two different color emitting phosphors.

* * * * *

UNITED STATES PATENT OFFICE
CERTIFICATE OF CORRECTION

PATENT NO. : 4,028,575

DATED : June 7, 1977

INVENTOR(S) : John A. van Raalte

It is certified that error appears in the above-identified patent and that said Letters Patent are hereby corrected as shown below:

Column 2, line 16: change "1-2" to --2-2--.

Column 4, line 48: change "0" to --ten--.

Column 5, line 67: change "<j<m" to --0<j≤m--.

Column 6, line 34: insert a period after "members".

Column 7, line 60: in the first parenthesis change "w" to --2--.

Column 12, line 3: change "screenexcitable" to --screen excitable--.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*